US006578874B1

(12) United States Patent
Kubert et al.

(10) Patent No.: US 6,578,874 B1
(45) Date of Patent: Jun. 17, 2003

(54) METHOD FOR CORRECTING ARTICLES OF MAIL AND ARTICLE OF MAIL PRODUCED THEREBY

(75) Inventors: Vincent Kubert, Melbourne; John R. Pinchin, Palm Bay, both of FL (US); Steven Curtis, Amherst, NH (US)

(73) Assignee: Profold, Inc., Sebastian, FL (US)

( * ) Notice: Subject to any disclaimer, the term of this patent is extended or adjusted under 35 U.S.C. 154(b) by 0 days.

(21) Appl. No.: 09/524,679

(22) Filed: Mar. 13, 2000

(51) Int. Cl.[7] ..... B42D 15/00

(52) U.S. Cl. ..... 283/72; 40/630; 40/638; 229/74; 283/81; 283/116; 705/406; D19/3

(58) Field of Search ..... 283/72, 73, 81, 283/79, 106, 116; 229/68.1, 300, 301, 306, 74, 92.8; 40/299.01, 630, 638; 235/462.01; D19/3; 705/406, 408

(56) References Cited

U.S. PATENT DOCUMENTS

| | | | | | |
|---|---|---|---|---|---|
| 2,145,334 | A | | 1/1939 | Bergstein | 93/1 |
| 2,781,818 | A | | 2/1957 | Beckman et al. | 154/1.8 |
| 3,937,492 | A | * | 2/1976 | Biron | 282/25 |
| 3,966,193 | A | | 6/1976 | Storace et al. | 271/150 |
| 4,119,194 | A | | 10/1978 | Freeman et al. | 198/400 |
| 4,121,403 | A | | 10/1978 | Bogdanski et al. | 53/202 |
| 4,140,627 | A | | 2/1979 | Weller et al. | 209/3.3 |
| 4,183,779 | A | | 1/1980 | Barber et al. | 156/361 |
| 4,278,488 | A | | 7/1981 | Kopacz et al. | 156/351 |
| 4,422,241 | A | | 12/1983 | Meeker | 33/1 BB |
| 4,588,463 | A | | 5/1986 | Barber et al. | 156/200 |
| 4,606,715 | A | | 8/1986 | Larson | 425/110 |
| 4,607,433 | A | | 8/1986 | Meeker | 33/1 BB |
| 4,621,798 | A | | 11/1986 | Akers | 271/5 |
| 4,669,719 | A | | 6/1987 | Frantangelo | 271/251 |
| 4,701,238 | A | | 10/1987 | Boucher | 156/479 |
| 4,725,718 | A | | 2/1988 | Sansone et al. | 235/495 |
| 4,750,966 | A | | 6/1988 | Koller | 156/391 |
| 4,778,101 | A | | 10/1988 | Paquin | 229/73 |
| 4,795,042 | A | | 1/1989 | Klein et al. | 211/186 |
| 4,930,764 | A | | 6/1990 | Holbrook et al. | 271/119 |
| 4,955,483 | A | | 9/1990 | O'Dea et al. | 208/548 |
| 4,971,686 | A | | 11/1990 | O'Dea et al. | 209/548 |
| 4,973,037 | A | | 11/1990 | Holbrook | 271/2 |
| 5,114,437 | A | | 5/1992 | Olson | 271/251 |
| 5,214,901 | A | | 6/1993 | Milliner | 53/397 |
| 5,221,577 | A | * | 6/1993 | Inaba et al. | 428/354 |
| 5,285,958 | A | * | 2/1994 | Buescher | 229/305 |
| 5,294,100 | A | | 3/1994 | Scheibelhut | 270/54 |
| 5,393,366 | A | | 2/1995 | Bell | 156/443 |
| 5,398,922 | A | | 3/1995 | Malatesta | 271/11 |
| 5,431,288 | A | | 7/1995 | Nishijima et al. | 209/584 |
| 5,440,979 | A | | 8/1995 | Bonham et al. | 101/91 |
| 5,595,044 | A | | 1/1997 | Kataigi | 53/396 |
| 5,607,100 | A | | 3/1997 | Stenner | 229/69 |

(List continued on next page.)

FOREIGN PATENT DOCUMENTS

EP 0 641 610 A2 8/1995

*Primary Examiner*—A. L. Wellington
*Assistant Examiner*—Monica Carter
(74) *Attorney, Agent, or Firm*—Allen, Dyer, Doppelt, Milbrath & Gilchrist, P.A.

(57) ABSTRACT

A method of correcting an article of mail and the article is disclosed. The article of mail has opposing sides and an edge and identifying indicia positioned on at least one of the sides adjacent an edge. A dual neutralizing mask is applied onto at least a substantial portion of the edge and overlaps the opposing sides in an area adjacent the edge to neutralize by covering at least a major portion of the identifying indicia. The indicia has neutralized and cannot be used in subsequent mail processing.

43 Claims, 7 Drawing Sheets

U.S. PATENT DOCUMENTS

| | | | | | |
|---|---|---|---|---|---|
| 5,630,899 | A | | 5/1997 | Meschi | 156/217 |
| 5,673,309 | A | | 9/1997 | Woynoski et al. | 379/144 |
| 5,703,783 | A | * | 12/1997 | Allen et al. | 364/478.01 |
| 5,880,453 | A | | 3/1999 | Wang et al. | 235/462.01 |
| 5,891,300 | A | | 4/1999 | Oussani, Jr. et al. | 156/541 |
| 5,918,909 | A | | 7/1999 | Fiala et al. | 283/61 |
| 5,978,781 | A | * | 11/1999 | Sansone | 705/408 |
| 6,039,257 | A | * | 3/2000 | Berson et al. | 235/468 |
| 6,142,380 | A | * | 11/2000 | Sansone et al. | 235/487 |
| 6,328,839 | B1 | * | 12/2001 | Lopez et al. | 156/212 |

* cited by examiner

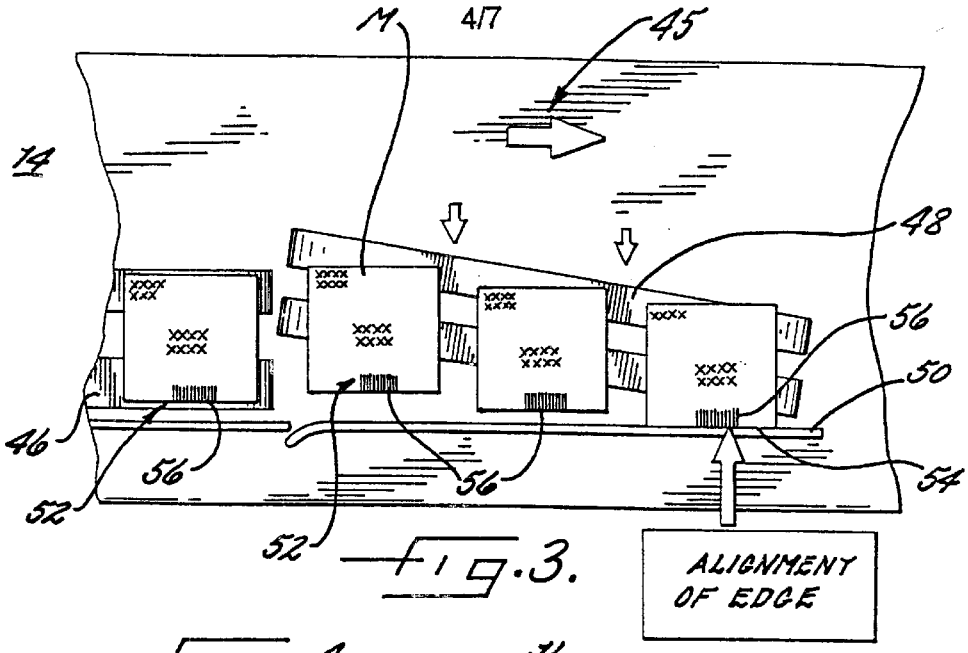
Fig.3.
Fig.4.
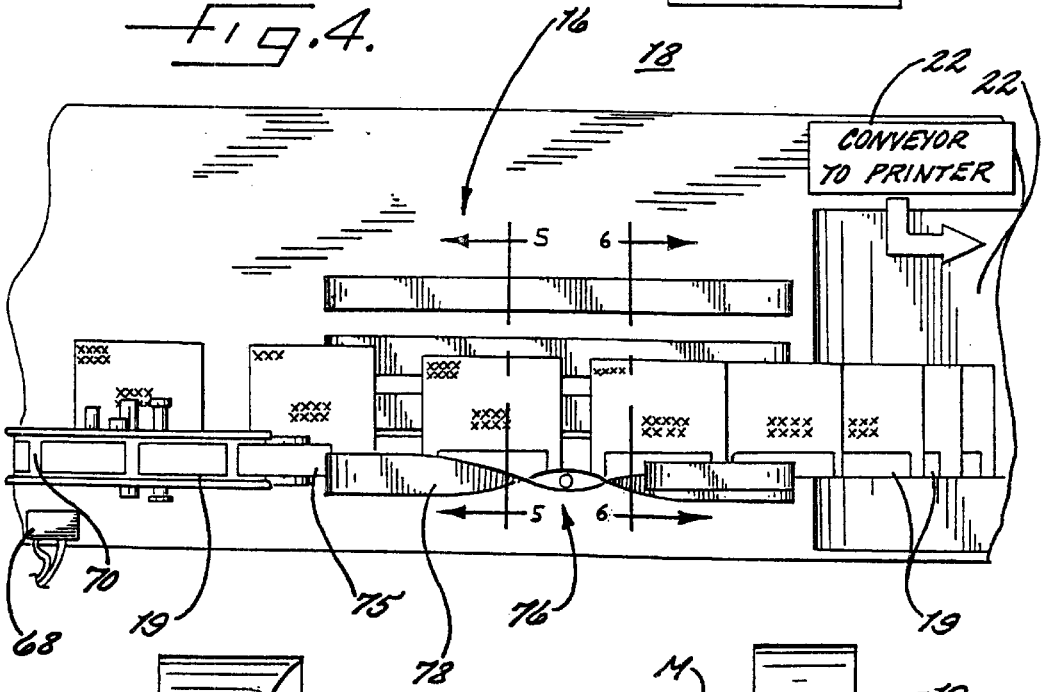
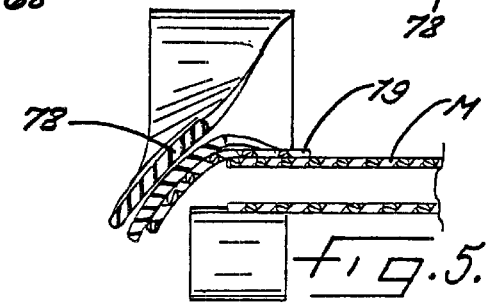
Fig.5.
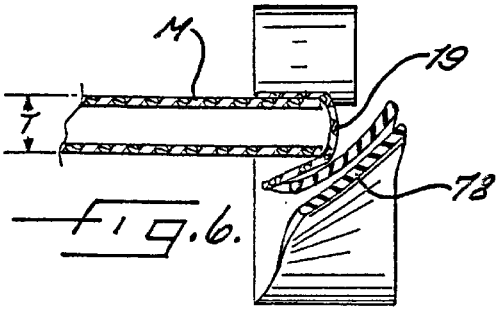
Fig.6.

METHOD FOR CORRECTING ARTICLES OF MAIL AND ARTICLE OF MAIL PRODUCED THEREBY

FIELD OF THE INVENTION

This invention relates to the field of mail processing, and more particularly, this invention relates to the field of correcting articles of mail during mail processing.

BACKGROUND OF THE INVENTION

The routing and delivering of articles of mail, whether performed by the United States Post Office, United Parcel Service or other private mail and/or parcel delivery company, is increasingly becoming more efficient and streamlined. Often, mail handling is automated through complicated and efficient mail sorting and handling equipment. To expedite the processing, handling and delivery of mail, it has become more common to position identifying indicia on the front and/or rear side of a mail piece or package to expedite processing. Examples of these indicia are the various ID tags that are sprayed by ink jetting onto the rear side of mail pieces, such as envelopes or other bundled packages that are held together by tabs. Other identifying indicia, such as a bar code, are also printed, such as by ink jetting, onto the front side of the mail pieces or packages to assist in mail routing. An ID code, bar code and/or any other identifying indicia, whether placed on the front or rear sides of packages or mail pieces, are used for internal routing within the post office and mail delivery at the route level. These identifying indicia help identify the mail to the sender or delivery agent, help route the mail, and help in tracking the mail, whether the mail is a bulk item or individual mail piece.

However, as is common today, thousands of mail pieces are either not delivered because the mail pieces are misrouted, or the mail pieces arrive late because of poor misrouting. Some mail pieces have to be returned to the sender. As of now, the United States Post Office, or other similar mail delivery services, must cover any identifying indicia, such as a bar code or ID tag, with a label, which could subsequently be sprayed with a new bar code. If both sides of a mail piece must be covered, then two processing steps are required to affix a label to either side of the mail piece. For example, if an article of mail, such as an envelope, has a bar code on the front side, and an ID code on the rear side, the mail service will cover the incorrect bar code with a label, and then pass the article of mail under a printhead that is electronically controlled by a computer and database to print the proper information, such as a new identifying indicia or a new bar code. Then, the article of mail will be processed twice in two steps by flipping the mail piece over and applying another label on the rear side to cover the incorrect ID code or other identifying indicia so that any subsequent mail processing of the ID code, bar code, or other identifying matter, will be neutralized and not used in subsequent mail processing. Also, the labels will cover any noise, which hinders optical character recognition. This type of double pass/double label application is inefficient, and adds much time and expense to mail processing.

SUMMARY OF THE INVENTION

It is therefore an object of the present invention to provide a one-step process that corrects an article of mail and neutralizes indicia that are positioned on the article of mail.

It is yet another object of the present invention to neutralize noise, bar codes, and identifying indicia on an article of mail with minimum processing.

In accordance with the present invention, a method of correcting an article of mail comprises the step of feeding an article of mail into a mail correcting station. The article of mail comprises a mail piece having opposing sides and an edge and identifying indicia positioned on at least one of the sides adjacent an edge. A dual neutralizing mask is applied onto at least a substantial portion of the edge and overlaps the opposing sides in an area adjacent the edge to cover at least a major portion of the identifying indicia to correct the article of mail, such that the indicia is neutralized and cannot be used in subsequent mail processing.

In one aspect of the present invention, return-to-sender information is printed on the dual neutralizing mask on at least one overlapping side of the mask. The method can also comprise the step of printing informational indicia on the dual neutralizing mask on at least one overlapping side of the mask. This indicia could be bar codes, printed dots, or any other identifying indicia that could be suggested or known by those skilled in the art. This identifying indicia can be printed by ink jetting the informational indicia on the at least one overlapping portion of the mask.

In still another aspect of the present invention, the mail is oriented about a predetermined angle of orientation prior to the step of applying the dual neutralizing mask on the mail piece. This dual neutralizing mask can be provided as a flexible, self-adhesive member that is adhesively attached to the opposing sides of the mail piece along the edge. It can be supplied from a supply roll where the flexible, self-adhesive member is positioned on a carrier web and peeled therefrom during processing.

In yet another aspect of the present invention, the method of correcting articles comprises the step of feeding a plurality of articles of mail successively into a mail correcting station. Each of the articles of mail comprise a mail piece having opposing sides and an edge and an identifying indicia positioned on at least one of the sides adjacent the edge. The dual neutralizing mask is applied onto each of the mail pieces by applying the dual neutralizing mask onto at least a substantial portion of the edge to overlap opposing sides in an area adjacent the edge, while covering at least a major portion of the identifying indicia to correct the mail piece such that the identifying indicia is neutralized and cannot be used in subsequent mail processing. The mail pieces can comprise intermixed pieces of mail having a plurality of different widths, lengths, and thicknesses, and a commonly oriented side on which the dual neutralizing mask is applied. The articles of mail can be fed from a mail bin where the articles of mail are stacked.

In still another aspect of the present invention, an article of mail includes a mail piece having opposing sides and an edge. Indicia corresponding to a post office code is positioned on at least one of the sides adjacent an edge. A dual neutralizing mask overlaps at least a substantial portion of the edge and covers the opposing sides in an area adjacent the edge and covers at least a major portion of the indicia for correcting the article of mail such that the indicia is neutralized and cannot be used in subsequent mail processing. This dual neutralizing mask can comprise an elongate and flexible, self-adhesive member that is adhesively attached to the opposing sides adjacent and along the edge. The edge of the mail pieces defines a longitudinal edge and the dual neutralizing mask extends a distance greater than half the length of the mail piece along the edge. The mail piece can comprise an envelope and the indicia can comprise printed indicia, such as a bar code. Return-to-sender information is printed on the dual neutralizing mask on at least one side that overlaps the mask.

In another aspect of the present invention, the mail piece defines front and rear sides with a bar code printed on the front side adjacent the edge and an ID code printed on the rear side adjacent the edge. Both the bar code and ID code are substantially neutralized by the dual neutralizing mask of the present invention.

In still another aspect of the present invention, the article of mail can comprise a mail package having opposing sides and an edge. Indicia corresponding to a post office code is positioned on at least one of the sides adjacent an edge. A dual neutralizing mask overlaps at least a substantial portion of the edge and covers the opposing sides in an area adjacent the edge and covers at least a major portion of the indicia for correcting the article of mail such that the indicia is neutralized and cannot be used in subsequent mail processing.

BRIEF DESCRIPTION OF THE DRAWINGS

Other objects, features and advantages of the present invention will become apparent from the detailed description of the invention which follows, when considered in light of the accompanying drawings in which:

FIG. 3 is a fragmentary, top plan view of the mail correcting apparatus that can be used for correcting articles of mail and illustrating the alignment and registration of the edges of mail pieces.

FIG. 4 is another fragmentary, top plan view of the mail correcting apparatus that can be used for the method of the present invention illustrating how a dual neutralizing mask is received on a mail piece and how the apparatus twists the dual neutralizing mask into overlapping engagement with both sides adjacent the aligned edge.

FIGS. 5 and 6 are sectional views of the mail correcting apparatus taken along respective lines 5—5 and 6—6 of FIG. 4.

DETAILED DESCRIPTION OF THE PREFERRED EMBODIMENTS

The present invention is advantageous because it allows for the correction of articles of mail by applying a dual neutralizing mask that overlaps at least a substantial portion of an edge of an article of mail and covers opposing sides of the article in an area adjacent the edge to cover at least a major portion of identifying indicia, and neutralize the identifying indicia, such that the identifying indicia cannot be used in subsequent mail processing. Also, the dual neutralizing mask neutralizes noise, such as color, that inhibits optical character recognition. These identifying indicia can correspond to a post office identification code, bar code, or other identifying indicia, which are positioned on at least one of the sides adjacent an edge, as known to those skilled in the art.

The present invention can apply the dual neutralizing mask in a one step operation, as compared to prior art methods used at the United States Post Office, where a label had to be first affixed into a predetermined location, over an indicia located on a first side of a mail piece, such as an envelope having a bar code. Then, in subsequent processing, a second label is applied in a predetermined location onto the rear side to cover other indicia located adjacent the edge, such as an envelope having an ID code. The present invention provides for the covering and neutralizing of the indicia, and the neutralizing of noise, whether the indicia is printed on one or both sides.

Figure 7:
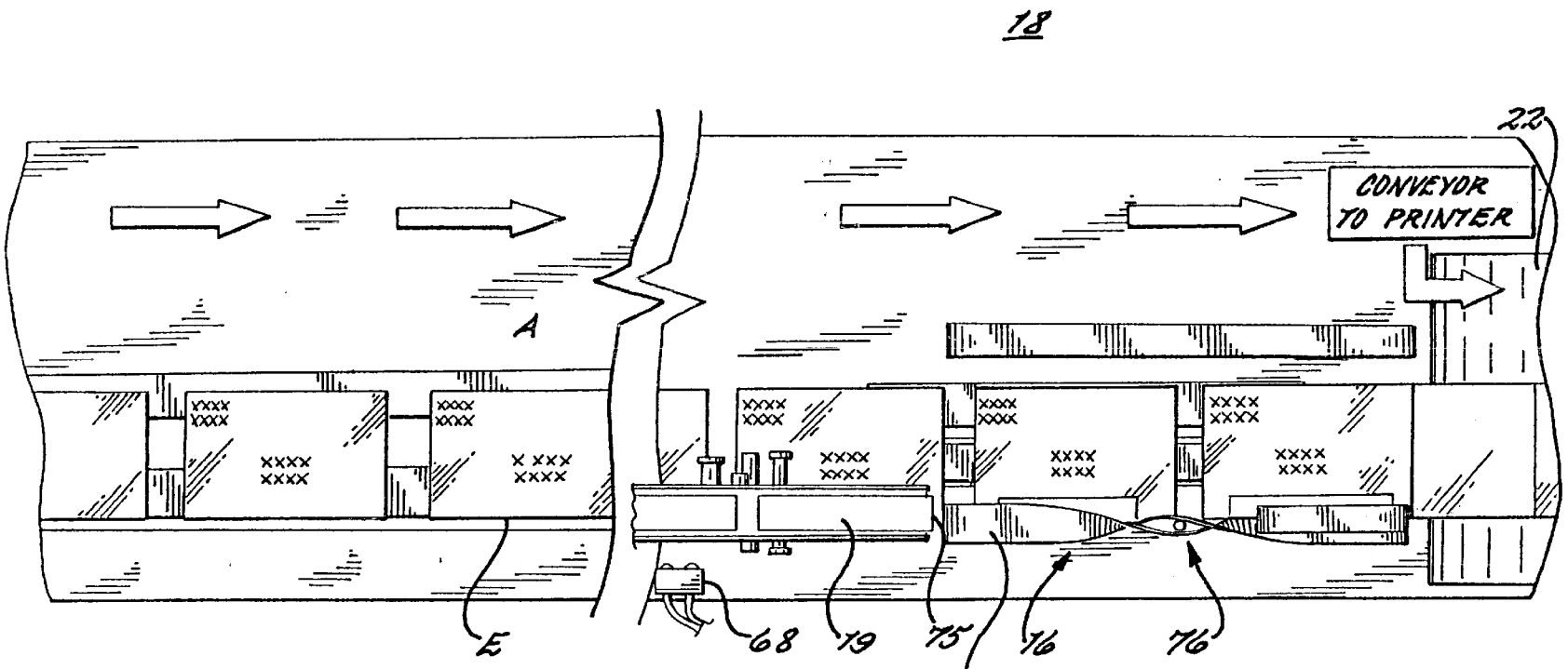
FIG. 7 is another fragmentary plan view of an example of a mail correcting apparatus of the present invention showing how mail pieces can be longitudinally conveyed and corrected with the present invention.

FIG. 1 shows a fragmentary perspective view of an example of a mail correcting apparatus 10 that can be used for correcting articles of mail (M) in accordance with one aspect of the present invention. The apparatus 10 includes major components as shown in the block diagram of FIG. 2. A mail feeder holds a stack (S) of articles of mail in a stacked, horizontal configuration, with the articles vertically oriented on end. The articles are fed to an optional mail orientor 14, which can be used for turning the articles of mail (M) 90° to align an edge for processing, if necessary. The orientor 14 is an optional component that may not be necessary if in-line processing is done, such as shown in the embodiment of FIG. 7. A dual neutralizer mask applicator 16 is positioned at a mail correcting station 18 and applies the dual neutralizing mask 19 of the present invention. A printer 20, for example, formed as an ink jet printer, prints corrected indicia, such as another bar code or other identifying indicia, onto the dual neutralizing mask 19. The article of mail (M) is then fed into a conveyor 22 and then into a sorting station 24, where the articles of mail are sorted and placed into bins.

Throughout this description, the articles of mail (M) are described as mail pieces, and illustrated as envelopes, as an example only. However, the articles of mail can also be bundled papers, envelopes or other mail pieces that are placed together as a package and held by a tab or series of tabs, and having identifying indicia printed thereon. This package then can be corrected by the method and correcting apparatus of the present invention to form a corrected article of mail, e.g., package.

As illustrated, the mail feeder 12 can be an intermixed mail feeding means, e.g., preferably provided by an intermixed mail feeder, and feeds a plurality of mail pieces that could be intermixed, such as having a plurality of different widths (W), lengths (L) and thicknesses (T), so that each of the plurality of intermixed pieces of mail preferably have a commonly oriented edge that will have the dual neutralizing mask 19 of the present invention applied. Although different thicknesses of mail pieces could be processed, as an example only, the present invention can process mail pieces having a thickness that ranges from 0.007 to about 0.25 inches and a physical size of width (W) and length (L), for example, from 3.5 inches to about 5.0 inches to about 8.5 inches to about 11.5 inches, as an example only. Other sizes could naturally be processed in the present invention.

The mail pieces are stripped one at a time from the stripper belt mechanism 30, which includes stripper rolls 32 having a plurality of stripper belts 34 positioned on the stripper rolls 32. The belt mechanism can include a vacuum assist to assist in drawing mail pieces against the stripper belts. The friction that exists between the mail piece and the stripper belts 34 allows an article to be "stripped" or drawn away in singulated fashion once-by-one from the stack (S) of mail pieces contained in the mail feeder 12 and into a feed discharge belt assembly 36, via a preshingler and stripper fingers (not shown). Pressure can be applied onto the stack of mail pieces by an article retaining plate 38 that is slidably moveable on a guide rod (not shown) and positioned adjacent a mail feeder side support 40. The retaining plate 38 can be moved forward by a spring biasing mechanism that moves the plate against the mail pieces. A motor driven conveyor belt 42 can also be used to aid in advancing mail pieces against the stripper belts 34.

As noted before, mail pieces (M) pass into the feed discharge belt assembly 36 in vertical orientation, as in this one example, and onto a transport register table as part of a conveyor system. Up to this point in time, the mail pieces have been processed in vertical orientation, i.e., "standing up." At this time, the article is laid flat by a twisted belt feed section 44, which rotates the mail pieces 90° to lay the mail pieces flat for subsequent correcting at the mail correcting station 18. Naturally, the apparatus components could also include an air transport table (or other high speed transport table) as associated with the twisted belt feed section. An example of a twisted belt feed section and associated components is shown and disclosed in U.S. Pat. No. 5,393,366 and assigned to the present assignee of the present invention, Profold, Inc., the disclosure which is hereby incorporated by reference in its entirety.

After the mail pieces are laid flat, they are transported by the conveyor mechanism into the mail correcting station 18, which could include an orienting means, e.g., an orientor or rotator 14, that orients the mail pieces about a predetermined angle, e.g., preferably 90°, to orient and then register the edge that will have the dual neutralizing mask applied. The orientor 14 is an optional component, which can be used when the type of mail pieces that are stacked in the feeder must be turned and aligned. The orientor, in effect, uses a "bump turn" or pivot point, where mail pieces abuttingly contact or bump into any contacting edge, and are stopped, such that the mail piece is turned or rotated about the pivot point, as noted, as an example, in the incorporated by reference '366 patent.

Figure 1A:
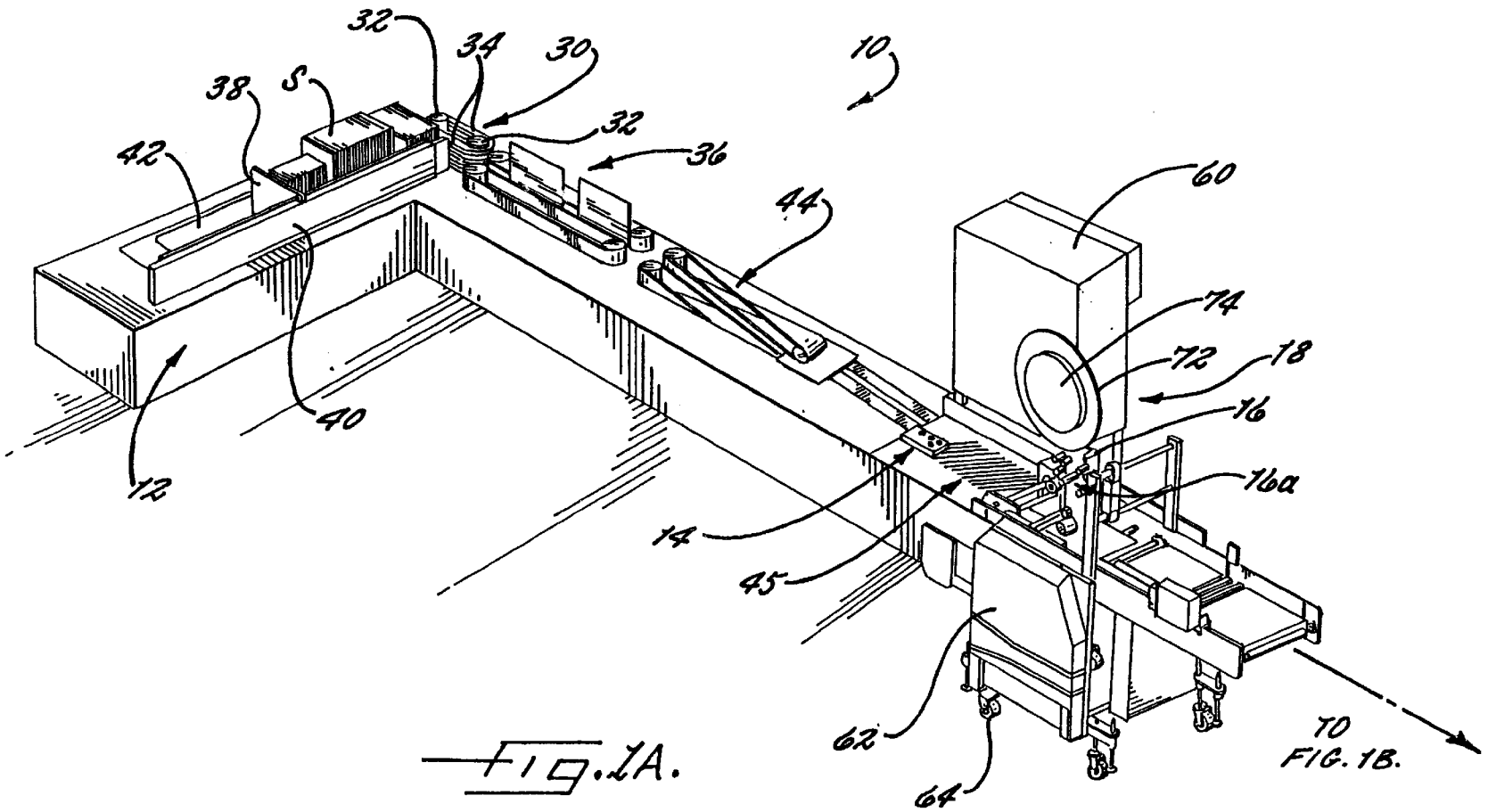
FIGS. 1A and 1B are fragmentary, perspective views of a mail correcting apparatus that can be used for the method of correcting articles of mail and producing the article of mail in accordance with the present invention.
Figure 2:
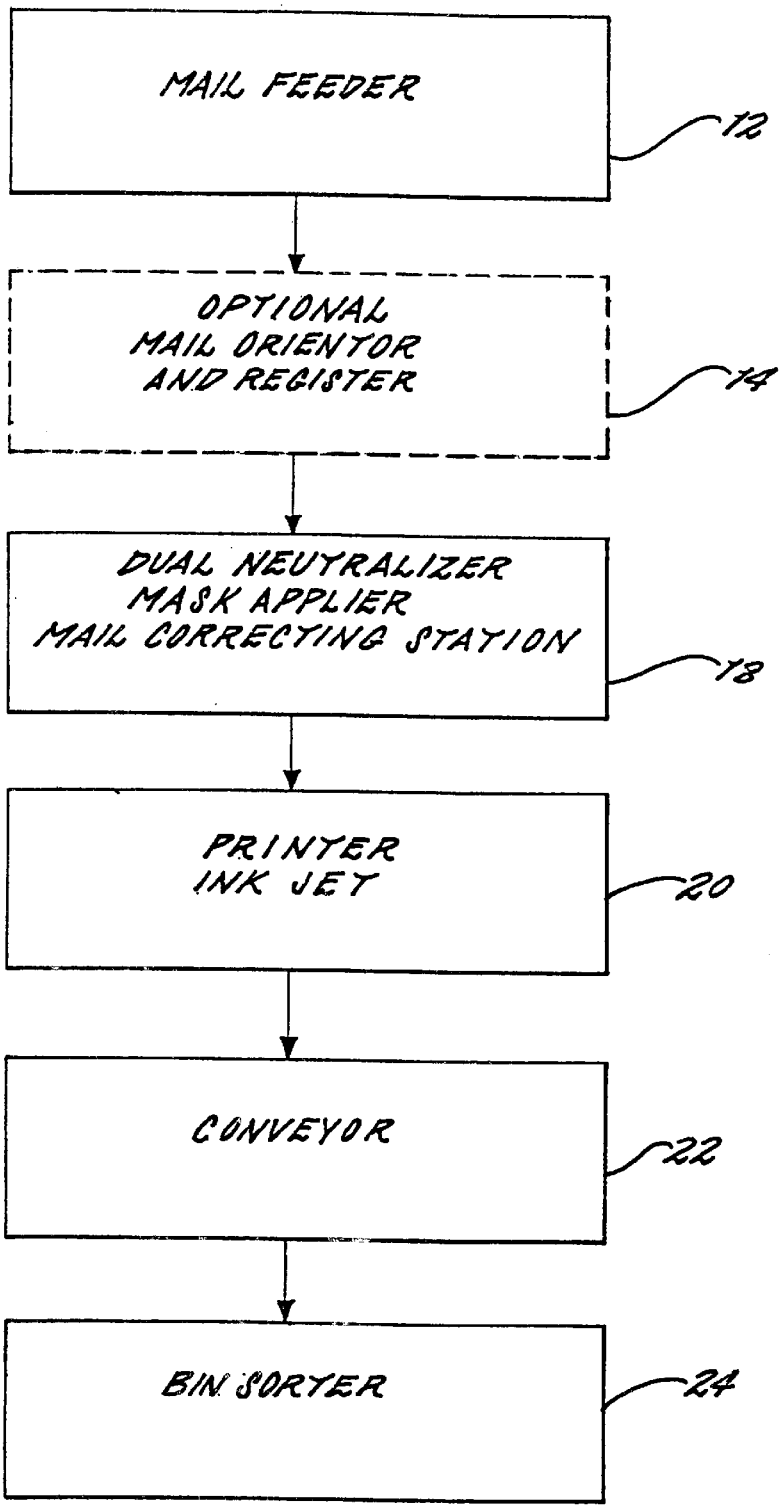
FIG. 2 is a schematic flow diagram of an example of the major apparatus components used in the method for correcting articles of mail.

FIG. 3 illustrates mail pieces (M) that have been oriented and then registered or edge aligned via a mail register 45, at the mail correcting station 18, so that the edges are aligned for application of the dual neutralizing mask 19. The mail pieces are fed from an orientor conveyor belt 46 as illustrated in FIGS. 1A and 3, which forms part of the orientor. The orientor conveyor belt 46 can be mounted on drive rolls and driven by one or more motors, positioned downstream from the orientor, for conveying the mail pieces downstream at the mail correcting station and registering or re-registering the mail pieces, as shown in FIG. 3. The mail register 45 also includes a plurality of conveyor belts 48 and a guide member 50, which stops the mail pieces and aligns the mail pieces along a common edge or side that will have the dual neutralizing mask applied thereto.

Figure 8:
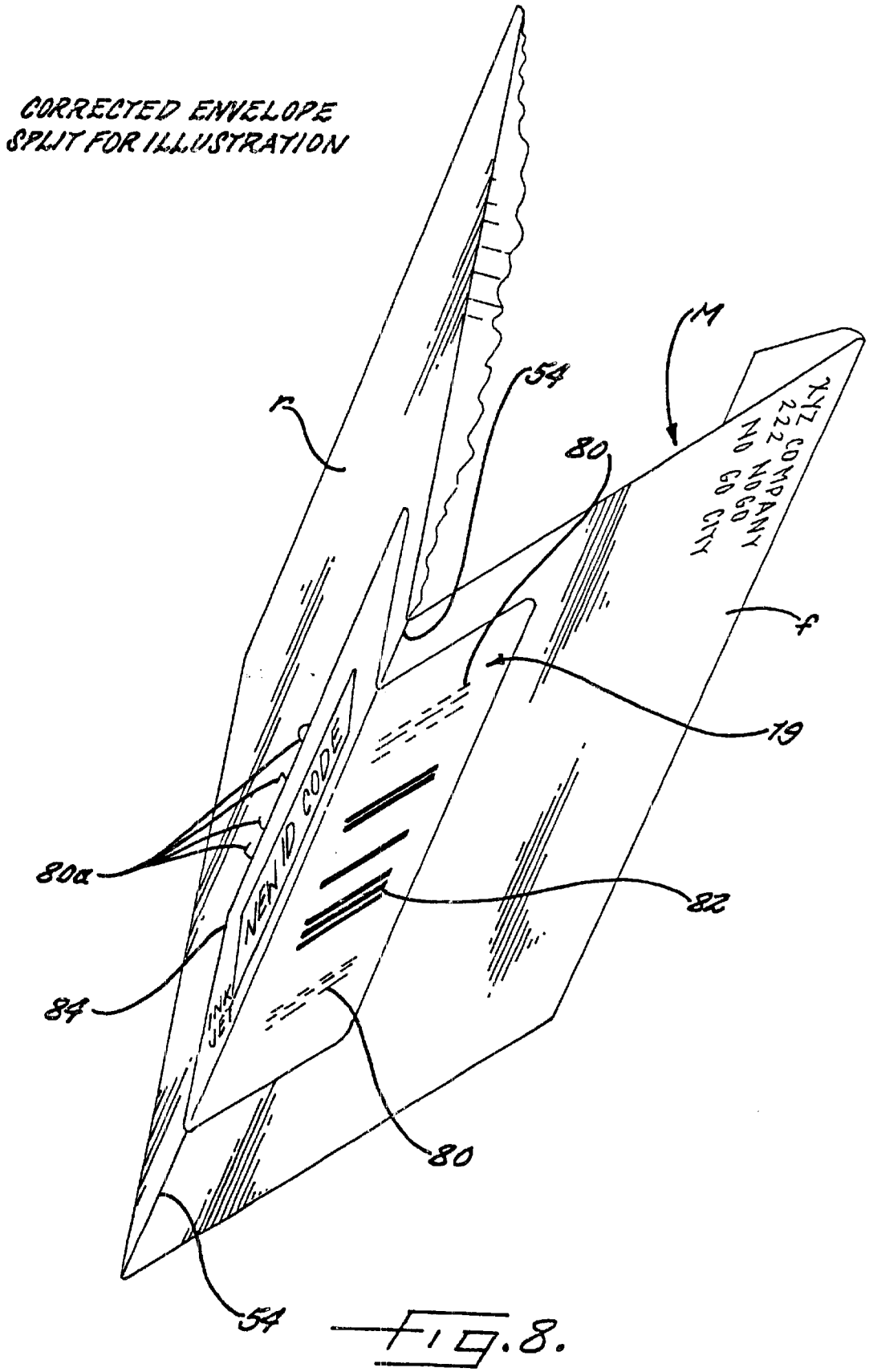
FIG. 8 is a fragmentary, isometric view of an article of mail formed as an envelope, which has a dual neutralizing mask applied onto the edge to overlap at least a substantial portion of the edge and cover opposing sides in an area adjacent the edge, and cover at least a major portion of the identifying indicia for correcting the article of mail, such that the indicia is neutralized and cannot be used in subsequent mail processing.

As shown in FIG. 3, the illustrated mail pieces (M) have a front side (f), as illustrated, and an opposing rear side (r), such as shown on the fragmentary and corrected mail piece of FIG. 8. Identifying indicia 52, corresponding to a post office code or other identifier, is positioned on at least one of the sides adjacent an edge 54. In the example shown in FIG. 3, a bar code 56 is printed on the front side adjacent the edge 54. This printed identifying indicia, however, can be any type of identifying indicia, and a bar code is only one example. Other examples of identifying indicia could include a series of dots, code, or other identifying indicia known to those skilled in the art. The rear side of the mail piece could include an ID tag or other identifying indicia, also positioned adjacent the edge 54, as known to those skilled in the art. The rear side, and sometimes front side, includes noise, such as color or glossy shine, that interferes with optical character recognition processes. Thus, the dual neutralizing mask can serve to neutralize this "noise" and permit printing of new identifying indicia or other information that can be readily read using common OCR equipment.

The mail correcting station 18 includes a controller 60, such as a computer, which preferably controls the entire mail correcting apparatus 10. Often, the various components of the mail correcting apparatus can be mounted on a frame 62 and wheels 64, such that individual apparatus components can be added and/or removed to and from the processing system. For example, ink jet printers could be removed or inserted into the processing stream as required.

The mail correcting station 18 includes a mask applicator 16 that is directly aligned with and adjacent the commonly oriented edge 54 to apply the dual neutralizing mask 19. A sensor 68, such as a photo cell or photo diode array, preferably senses the leading edge of each mail piece, and converts the sensed length to encoder counts that can be used to determine when the dual neutralizing mask should be applied. For example, if the leading edge of the mail piece is sensed, then the mask applicator 16 can be programmed so that the dual neutralizing mask is applied at a predetermined period of time after the leading edge has been sensed, thus allowing application of the dual neutralizing mask 16 at a predetermined point along the edge of mail pieces, such that the desired noise or older identifying indicia will be neutralized.

The dual neutralizing masks 19 are carried on a carrier web 70 that is wound on a supply roll 72 of a roll dispenser 74, which dispenses the dual neutralizing masks onto the mail pieces. The dual neutralizing masks are formed from a resilient, flexible material, such as a think plastic material, of a type that is commonly used in the mail industry for labels, tabs and the like. A polyethylene or similar plastic material can be used. The masks have an adhesive applied on the side to allow adhesive securing of the mask onto a mail piece. The opposing side of the mask is formed such that it can be printed, such as by ink jetting. The carrier web is also flexible, such as formed from plastic.

As shown in FIG. 4, a dual neutralizing mask 19 has a leading edge 75 that is peeled away from its carrier web 70 during processing. A hold down member, such as part of a mask wrapper 76, presses downward on the leading edge 75 of the dual neutralizing mask 19 and applies the leading edge onto the mail piece (M), which in this example, is the front side of an envelope. The mask applicator 16 also includes the tension rolls, guide rolls and hold down members and associated rolls, which are all indicated generally at 16*a*. One skilled in the art would recognize the type of mechanism required for initially peeling the leading edge of the mask from the carrier web, stripping the mask therefrom, and applying the mask onto the mail piece.

As shown in FIGS. 5 and 6, as the mail pieces advance along the conveyor, the mask wrapper 76 wraps and folds a respective dual neutralizing mask 19 around the commonly oriented edge 54 of the mail piece, such that the dual neutralizing mask overlaps at least a substantial portion of the edge and covers the opposing front and rear sides in an area adjacent the edge, while covering at least a major portion of the indicia for correcting the article of mail such that the indicia is neutralized and cannot be used in subsequent mail processing. Any OCR noise is also neutralized in the covered areas. The mask wrapper is formed from the appropriate belts 78 that achieve the wrapping function, and can be designed and configured depending on the size and dimensions of the dual neutralizing mask to be applied.

As shown in FIG. 8, the dual neutralizing mask 16 can be about 50% or more than the length of the edge defining the mail piece, in this example, an envelope. Although the length of the dual neutralizing mask can vary depending on what codes or other identifying indicia and "noise" must be neutralized and covered, a mask 16 that extends a substantial distance such as 30% to 50% would not be uncommon.

As shown in FIG. 8, an older, inaccurate bar code 80 on the front side of a mail piece has been neutralized and covered and a portion of an older ID code 80*a* has been covered and neutralized on the rear side. As illustrated, only a small portion of the older ID code 80*a* is shown. Thus, the older ID code 80*a* and older bar code 80 have been neutralized, such that these older codes cannot be inadvertently used in subsequent mail processing, which would create erroneous mail routing errors or other mail processing errors.

The mail correcting station 18 can accommodate thousands of pieces per hour, as much as 30,000 pieces per hour, which allows efficient correction of mail pieces. After having the dual neutralizing mask 19 applied, the mail piece(M) is then fed by a conveyor into a printer 20, which in the illustrated embodiment is a two-head ink jet printer, such as a Profold Projet produced by Profold, Inc. of Sebastian, Fla., as an example. This printer 20 can print addresses, bar codes, dotted bar codes, logos, FIN marks and other identifying indicia on one and/or the other overlapping side portions of the dual neutralizing mask, which covers a substantial portion of the edge 54 and opposing sides. For example, as shown in FIG. 8, a new bar code 82 has been printed on the front side (f) of the dual neutralizing mask 19. Depending on the type of mail pieces used and the system, another ink jet printhead located below the mail piece could print a new ID code 84 as illustrated. A non-solvent vegetable oil-based ink can be used as the printing ink with the illustrated ink jet printhead. The controller 60 that is incorporated at the mail correcting station 18, preferably controls operation of the printer 20. As illustrated, the printer 20 includes a conveyor belt 86, frame 88, wheels 90, and ink jet printheads 92, as known to those skilled in the art. Hold down rollers 94 work in conjunction with the conveyor 86 to stabilize any mail pieces as they are printed.

Figure 1B:
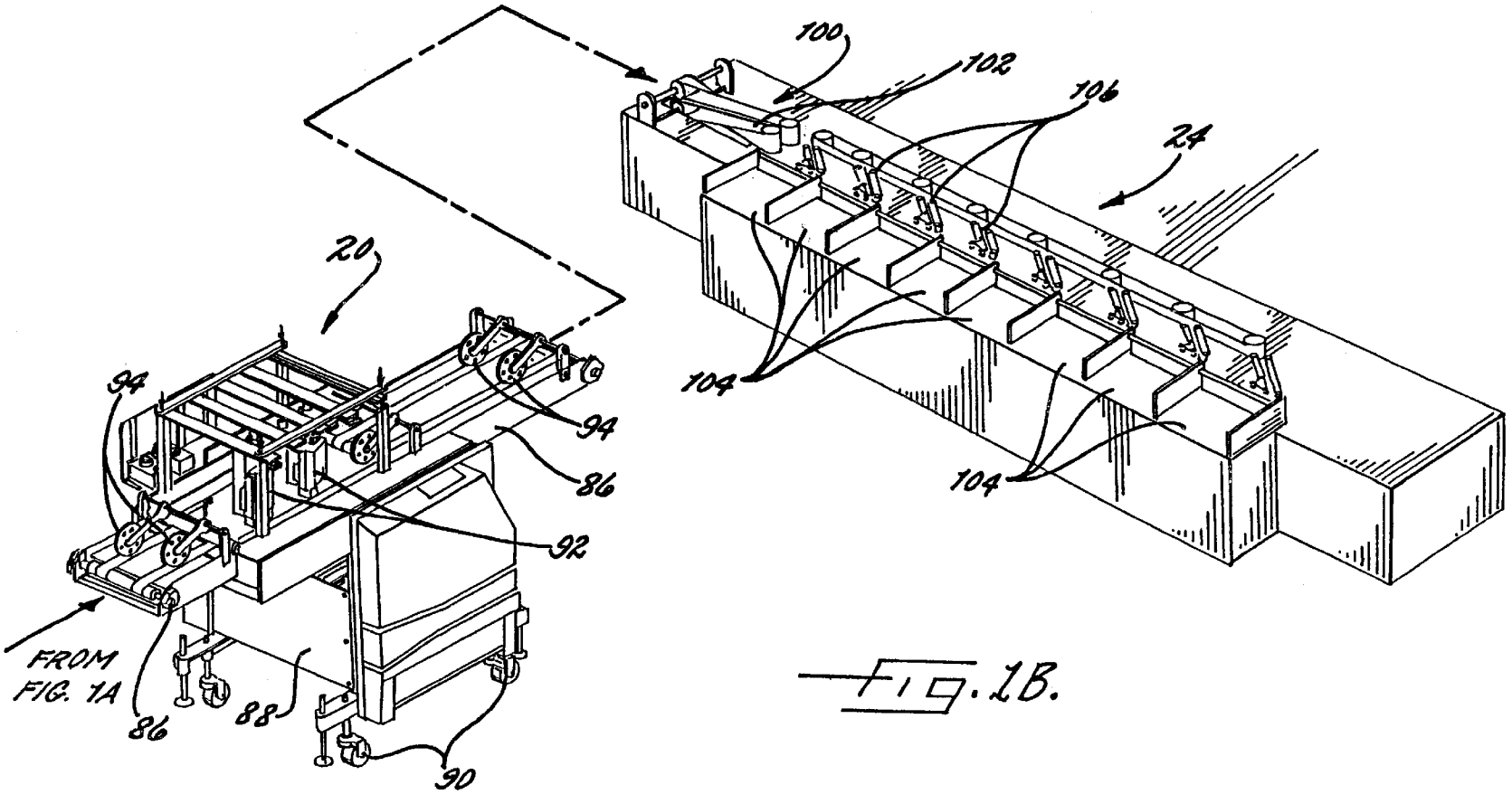

Once the mail pieces have been corrected with the application of the dual neutralizing mask 19, the mail pieces are transported into a mail piece stand-up feed section 100, where a 90° feed belt section 102 turns the mail pieces vertical, i.e., in "standing up" orientation. The mail pieces are fed into the sorting station 24, such as shown in FIG. 1B, where a plurality of mail bins 104 receive mail pieces from respective feed belt assemblies 106, FIG. 7 shows an embodiment of the mail correcting apparatus where mail pieces are not oriented by an orientor, but are fed straight along the conveyor and directly into the mail correcting station 18 where the dual neutralizing masks are applied from the supply roll onto respective mail pieces as they are fed. Register conveyor belts 48 and a guide member, as described above, could still be used, if necessary.

Figure 9:
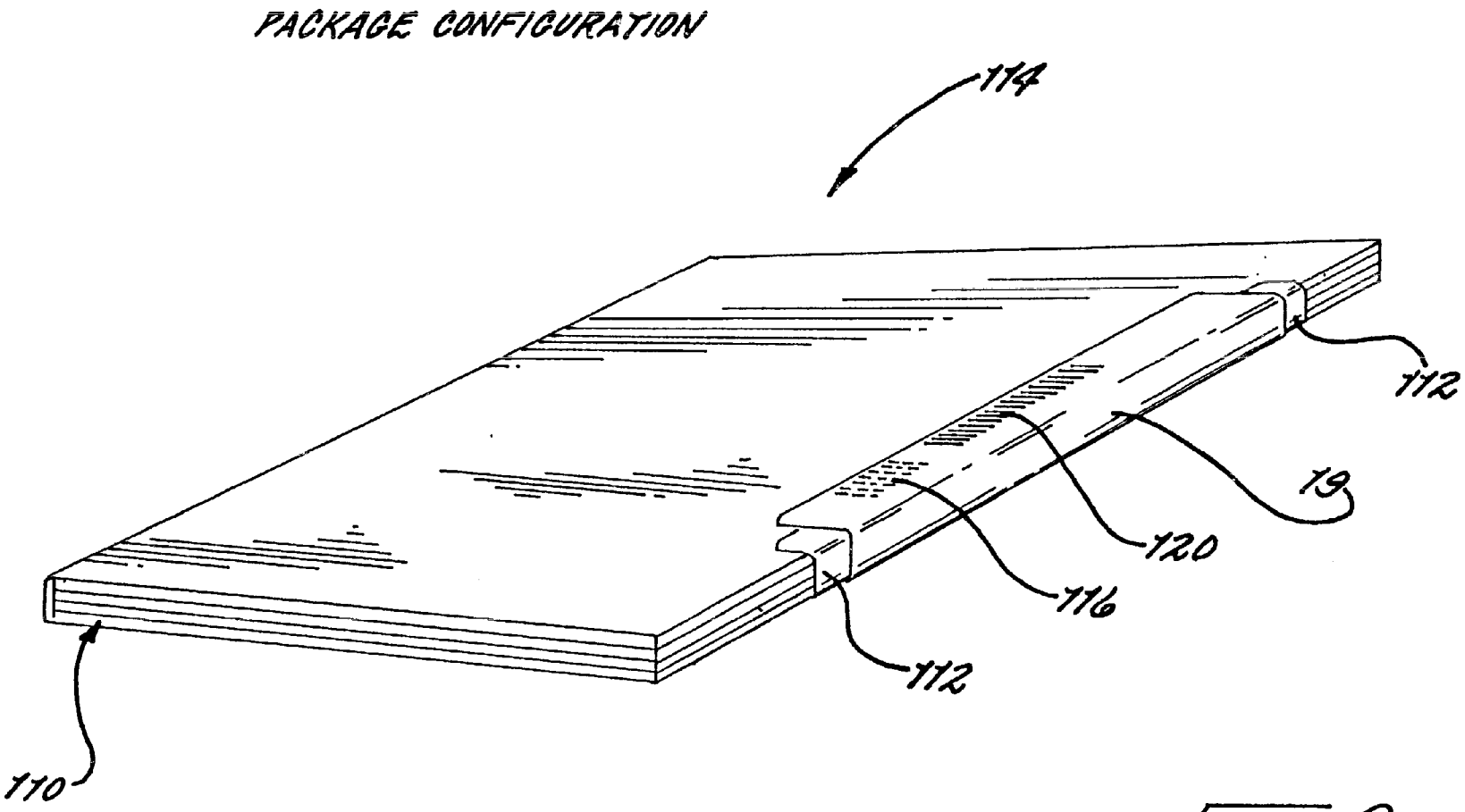
FIG. 9 is another fragmentary, isometric view of an article of mail that is formed by a plurality of mail pieces that are bound together by a tab, and having a dual neutralizing mask applied to the package to neutralize identifying indicia.

Referring now to FIG. 9, there is shown a stack 110 of mail pieces that have been previously bound together with tabs 112, to retain the mail pieces together as a package 114. The stack of mail pieces could also be formed as separate pieces of paper, such as flyers, that form the package. The package 114 has an older bar code 116 printed near an edge, which has to be corrected. The package 114 is processed through the mail correcting apparatus 10 of the present invention, where the dual neutralizing mask 19 of the present invention is applied. As shown in FIG. 9, the package 114 forming the article of mail has been corrected with the present invention, and a dual neutralizing mask 19 has been applied. A new bar code 120 is shown printed on the dual neutralizing mask, which covers and neutralizes the older bar code 116. Other articles of mail besides the illustrated packages and envelopes can also be corrected with the present invention, as suggested to those skilled in the art.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An article of mail comprising:

a mail piece having opposing sides and an edge;

indicia corresponding to a post office code positioned on at least one of said sides adjacent an edge; and an elongate dual neutralizing mask formed as a flexible, self-adhesive member that attaches to and overlaps at least a substantial portion of said edge and covers said opposing sides in an area adjacent said edge and covers at least a major portion of said indicia for correcting said article of mail such that said indicia is neutralized for scanning and/or optical character recognition and cannot be used in subsequent mail processing.

2. An article according to claim 1, wherein said edge of said mail piece defines a longitudinal edge, and said dual neutralizing mask extends a distance greater than half the length of said mail piece along said edge.

3. An article according to claim 1, wherein said mail piece comprises an envelope.

4. An article according to claim 1, wherein said indicia comprises printed indicia.

5. An article according to claim 1, wherein said indicia comprises a bar code.

6. An article according to claim 1, and further comprising Return-to-Sender information printed on said dual neutralizing mask on at least one side that overlaps.

7. An article according to claim 1, and further comprising printed mail identifying indicia on said dual neutralizing mask on at least one side that overlaps.

8. An article of mail comprising:

a mail piece having opposing front and rear sides and an edge;

a bar code positioned on said front side adjacent said edge;

an ID tag positioned on said rear side adjacent said edge; and an elongate dual neutralizing mask formed as a flexible, self-adhesive member that attaches to and overlaps at least a substantial portion of said edge and covers said front and rear sides in an area adjacent said edge and covers at least a major portion of said bar code and ID tag for correcting said article of mail such that said bar code and ID tag are neutralized for scanning and/or optical character recognition and cannot be used in subsequent mail processing.

9. An article according to claim 8, wherein said edge of said mail piece defines a longitudinal edge, and said dual neutralizing mask extends a substantial portion greater than half the length of said mail piece along said edge.

10. An article according to claim 8, wherein said mail piece comprises an envelope.

11. An article according to claim 8, and further comprising Return-to-Sender information printed on said dual neutralizing mask on at least one side that overlaps.

12. An article according to claim 8, and further comprising the step of printing mail identifying indicia on said dual neutralizing mask on at least one side that overlaps.

13. A packaged article of mail comprising:

a plurality of mail pieces stacked into a mail package having opposing sides and an edge;

tabs positioned along at least one edge and binding together the plurality of mail pieces into the mail package;

indicia corresponding to a post office code positioned on at least one of said sides adjacent an edge; and an elongate dual neutralizing mask formed as a flexible, self-adhesive member that adhesively attaches to and overlaps at least a substantial portion of said edge adjacent indicia and covers said opposing sides in an area adjacent said edge and covers at least a major portion of said indicia for correcting said article of mail such that said indicia is neutralized for scanning and/or optical character recognition and cannot be used in subsequent mail processing.

14. An article according to claim 13, wherein said package defines a length along said edge, and said dual neutralizing mask extends a distance greater than half the length of said mail piece along said edge.

15. An article according to claim 13, wherein said indicia comprises printed indicia.

16. An article according to claim 13, wherein said indicia comprises a bar code.

17. An article according to claim 13, and further comprising the step of printing Return-to-Sender information on said dual neutralizing mask on at least one side that overlaps.

18. An article according to claim 13, and further comprising printed indicia on said dual neutralizing mask on at least one side that overlaps.

19. An article of mail comprising:

a mail piece having opposing sides and an edge;

identifying indicia positioned on at least one of said sides adjacent an edge; and an elongate dual neutralizing mask formed as a flexible, self-adhesive member that attaches to and overlaps said edge and covers said opposing sides in an area adjacent said edge and covers at least a major portion of said indicia for correcting said article of mail such that said identifying indicia is neutralized for scanning and/or optical character recognition and cannot be used in subsequent mail processing.

20. A method of correcting an article of mail comprising the steps of:

feeding an article of mail into a mail correcting station, said article of mail comprising a mail piece having opposing sides and an edge and identifying indicia positioned on at least one of said sides adjacent an edge; and applying an elongate dual neutralizing mask formed as a flexible, self-adhesive member onto at least a substantial portion of said edge and overlapping said opposing sides in an area adjacent said edge to cover at least a major portion of said identifying indicia to correct said article of mail such that said indicia is neutralized for scanning and/or optical character recognition and cannot be used in subsequent mail processing.

21. A method according to claim 20, and further comprising the step of printing Return-to-Sender information on said dual neutralizing mask on at least one overlapping side.

22. A method according to claim 20, and further comprising the step of printing identifying indicia on the dual neutralizing mask on at least one overlapping side.

23. A method according to claim 22, wherein the identifying indicia comprises a bar code.

24. A method according to claim 22, and further comprising the step of ink jetting the identifying indicia on the at least one overlapping side.

25. A method according to claim 20, and further comprising the step of orienting the mail piece about a predetermined angle of orientation prior to the step of applying the dual neutralizing mask on the mail piece.

26. A method according to claim 20, and further comprising the step of applying the dual neutralizing mask as a flexible, self-adhesive member that is adhesively attached to the opposing sides of the mail piece along the edge.

27. A method according to claim 26, and further comprising the step of feeding the dual neutralizing mask from a supply roll.

28. A method of correcting articles of mail comprising the steps of:

feeding a plurality of articles of mail successively into a mail correcting station, each of said articles of mail comprising a mail piece having opposing sides and an edge and an identifying indicia positioned on at least one of said sides adjacent an edge; and applying an elongate dual neutralizing mask formed as a flexible, self-adhesive member onto each of said mail pieces by applying a dual neutralizing mask onto at least a substantial portion of an edge and overlapping the opposing sides in an area adjacent said edge with the dual neutralizing mask while covering at least a major portion of said identifying indicia to correct said article of mail such that said identifying indicia is neutralized for scanning and/or optical character recognition and cannot be used in subsequent mail processing.

29. A method according to claim 28, wherein the articles of mail comprise intermixed pieces of mail having a plurality of different widths, lengths, and thicknesses and a commonly oriented side on which the dual neutralizing mask is applied.

30. A method according to claim 28, and further comprising the step of feeding the articles of mail from a mail bin where the articles of mail are stacked.

31. A method according to claim 28, and further comprising the step of printing Return-to-Sender information on said dual neutralizing mask on at least one overlapping side.

32. A method according to claim 28, and further comprising the step of printing identifying indicia on the dual neutralizing mask on at least one overlapping side.

33. A method according to claim 32, wherein the identifying indicia comprises a bar code.

34. A method according to claim 32, and further comprising the step of ink jetting the identifying indicia on the at least one overlapping side.

35. A method according to claim 28, and further comprising the step of orienting the mail piece about a predetermined angle of orientation prior to the step of applying the dual neutralizing mask on the mail piece.

36. A method of correcting an article of mail comprising the steps of:

feeding an article of mail into a mail correcting station, said article of mail comprising a mail piece having opposing front and rear sides and an edge, a bar code positioned on the front side adjacent the edge, and an ID tag positioned on the rear side adjacent the edge; and applying a dual neutralizing mask onto at least a substantial portion of said edge and overlapping said opposing front and rear sides with said dual neutralizing mask in an area adjacent said edge while covering at least a major portion of said bar code and ID tag with the dual neutralizing mask for correcting said article of mail such that said bar code and ID tag are neutralized and cannot be used in subsequent mail processing.

37. A method according to claim 36, and further comprising the step of printing Return-to-Sender information on said dual neutralizing mask on at least one overlapping side of said mask.

38. A method according to claim 36, and further comprising the step of printing identifying indicia on the dual neutralizing mask on at least one overlapping side of the mask.

39. A method according to claim 38, wherein the identifying indicia comprises a bar code.

40. A method according to claim 38, and further comprising the step of ink jetting the identifying indicia on the at least one overlapping side of the mask.

41. A method according to claim 36, and further comprising the step of orienting the mail piece about a predetermined angle of orientation prior to the step of positioning the dual neutralizing mask on the mail piece.

42. A method according to claim 36, and further comprising the step of applying the dual neutralizing mask as a flexible, self-adhesive member that is adhesively attached to the opposing faces of the mail piece along the edge.

43. A method according to claim 36, and further comprising the step of feeding the dual neutralizing mask from a supply roll.

* * * * *

UNITED STATES PATENT AND TRADEMARK OFFICE

CERTIFICATE OF CORRECTION

PATENT NO. : 6,578,874 B1
DATED : June 17, 2003
INVENTOR(S) : Kubert et al.

It is certified that error appears in the above-identified patent and that said Letters Patent is hereby corrected as shown below:

Title page,
Item [56], References Cited, U.S. PATENT DOCUMENTS, delete
"5,114,437 A 5/1992 Olson.....271/251"
substitute
-- 5,114,137 A 5/1992 Olson.....271/251 --

Signed and Sealed this

Fifth Day of August, 2003

JAMES E. ROGAN
*Director of the United States Patent and Trademark Office*